US007690613B2

(12) United States Patent
Bowman et al.

(10) Patent No.: US 7,690,613 B2
(45) Date of Patent: Apr. 6, 2010

(54) TRANSFORMER BASE FOR LIGHTING POLES

(75) Inventors: Joseph M. Bowman, Abingdon, VA (US); Ray Carl Minor, Abingdon, VA (US)

(73) Assignee: Kearney-National Inc., New York, NY (US)

( * ) Notice: Subject to any disclaimer, the term of this patent is extended or adjusted under 35 U.S.C. 154(b) by 194 days.

(21) Appl. No.: 11/657,673

(22) Filed: Jan. 25, 2007

(65) Prior Publication Data

US 2007/0194874 A1 Aug. 23, 2007

Related U.S. Application Data

(60) Provisional application No. 60/761,774, filed on Jan. 25, 2006.

(51) Int. Cl.

| | |
|---|---|
| ***A47B 91/00*** | (2006.01) |
| ***A47G 29/00*** | (2006.01) |
| ***B65D 19/00*** | (2006.01) |

(52) U.S. Cl. ..... 248/346.01; 248/346.03; 248/519

(58) Field of Classification Search ..... 248/548, 248/346.01, 346.03, 511, 518, 519, 529; 52/736.4, 296, 297, 726.4; 312/263, 108
See application file for complete search history.

(56) References Cited

U.S. PATENT DOCUMENTS

| | | | | |
|---|---|---|---|---|
| 3,343,322 | A * | 9/1967 | Lurkis et al. | 52/298 |
| 3,552,073 | A * | 1/1971 | Millerbernd | 52/98 |
| 4,600,252 | A * | 7/1986 | Barber | 312/263 |
| 4,813,199 | A | 3/1989 | Lewis, Jr. | |
| 6,240,689 | B1 * | 6/2001 | Haddad et al. | 52/298 |
| 6,256,961 | B1 | 7/2001 | Byrnes | |
| 7,219,873 | B2 * | 5/2007 | Harwood | 248/519 |
| 2003/0205006 | A1 * | 11/2003 | Conner et al. | 52/98 |

* cited by examiner

*Primary Examiner*—Amy J Sterling
(74) *Attorney, Agent, or Firm*—Buchanan Ingersoll & Rooney PC

(57) ABSTRACT

A breakaway transformer base for a lighting pole includes four upstanding corner members (preferably formed of aluminum castings), and four side sheets. Each side sheet is attached to two of the corner members, e.g., by welds or fasteners, thereby interconnecting the corner members. Each corner member forms bolt holes for enabling the base to be bolted to a lighting standard and to an anchored foundation.

16 Claims, 5 Drawing Sheets

TRANSFORMER BASE FOR LIGHTING POLES

The present invention claims priority under 35 U.S.C. §119 and/or §365 to U.S. Provisional Application Ser. No. 60/761,774 filed on Jan. 25, 2006.

BACKGROUND OF THE INVENTION

The present invention relates to a transformer base mounted at the bottom of lighting poles or standards, as well as to a kit for forming such a base, and a method of making the base. Preferably, the base is of the breakaway type.

Lighting poles having breakaway transformer bases are known, wherein the transformer base, configured as a box of about 9" to 17" high, is adapted to break or shatter in response to lateral impact from a vehicle, thereby minimizing damage to the vehicle and its passengers. The transformer base may also provide access to wiring and sometimes house the luminaire transformer.

A prior art breakaway transformer base 10, shown in FIGS. 1-8, comprises a housing 12 having upper and lower pieces 14*a*, 14*b* formed of cast aluminum and welded together at 16. Bolt holes 18, 20 in the form of slots are formed at corners of the upper and lower pieces, respectively. The bolt holes 18 are located at the top of the upper piece 14*a*, and the bolt holes 20 are located at the bottom of the lower piece 14*b*. The lower bolt holes 20 receive bolts embedded in a concrete foundation (not shown), and the upper bolt holes receive bolts (not shown) for attaching a pole standard (not shown) to the base. The height of the base is about 17". Variations in anchor bolt and pole bolt circle diameters D1, D2 necessitate that several sizes of the transformer base be offered in order to cover the dimensional variations. That, in turn, requires separate tooling for differently-sized cast pieces 12, 14, and the need to maintain a relatively large inventory of the cast pieces.

It would be desirable therefore to provide a transformer base, preferably of the breakaway type, which has lower tooling requirements and smaller inventory maintenance.

It would also be desirable to provide a transformer base, especially of the breakaway type, which provides greater access to the base interior and/or which can be assembled in the field by the end user.

SUMMARY OF THE INVENTION

The invention relates to a transformer base for a lighting pole which comprises four substantially identical upstanding corner members. Each side sheet is secured to two of the corner members to connect those two corner members together. Each corner member includes at least one bolt hole at each end thereof.

Preferably, the corner members comprise castings.

Preferably the corner members and the side sheets are formed of aluminum.

Another aspect of the invention involves a kit comprised of the four corner members and the four side sheets.

A further aspect relates to a method of making the transformer base.

BRIEF DESCRIPTION OF THE DRAWING

The objects and advantages of the invention will become apparent from the following detailed description of a preferred embodiment thereof in connection with the accompanying drawing in which like numerals designate like elements.

DETAILED DESCRIPTION OF PREFERRED EMBODIMENTS

In accordance with the present invention, a transformer base can be manufactured using a modular concept, wherein some elements of the base (i.e., corner members) can be made in one size and yet used to make different-size bases. Those single-size elements comprise corner members which are to be connected to side sheets in order to form the transformer base. Changing of the base size is accomplished by providing different-size side sheets. The side sheets are preferably formed of light-weight sheet metal, so tooling requirements are reduced. Although an inventory of different-size side sheets has to be maintained, the overall bulk and volume of those sheets is relatively minor compared to the prior need to inventory the heavier corner members, especially when the corner members are castings.

Figure 12:
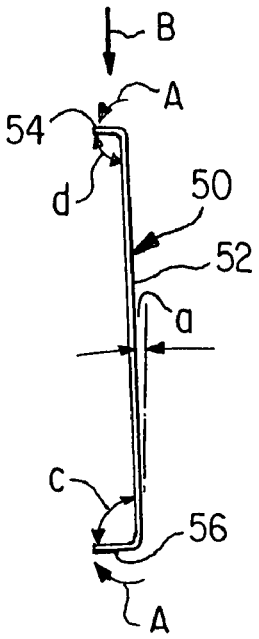
FIG. 12 is a side elevational view of the sheet shown in FIG. 11 after the flanges have been bent.
Figure 11:
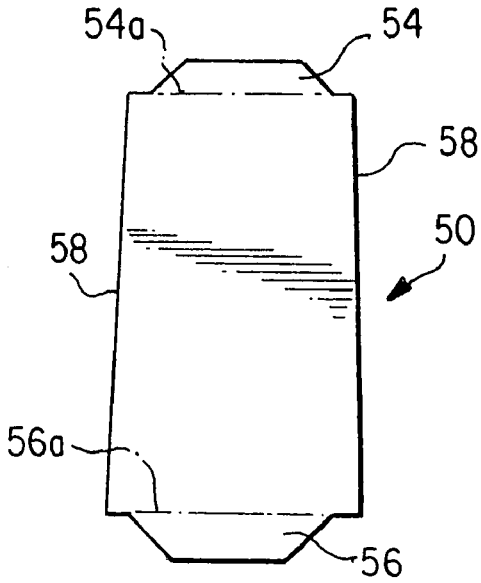
FIG. 11 is a side elevational view of an aluminum sheet having flanges which will be bent to form a side sheet according to the present invention.
Figure 13:
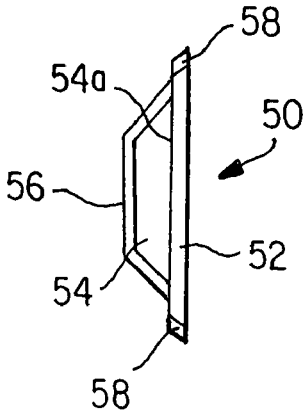
FIG. 13 is a top plan view of the sheet shown in FIG. 12 as seen in the direction of arrow B in FIG. 12.
Figure 15:
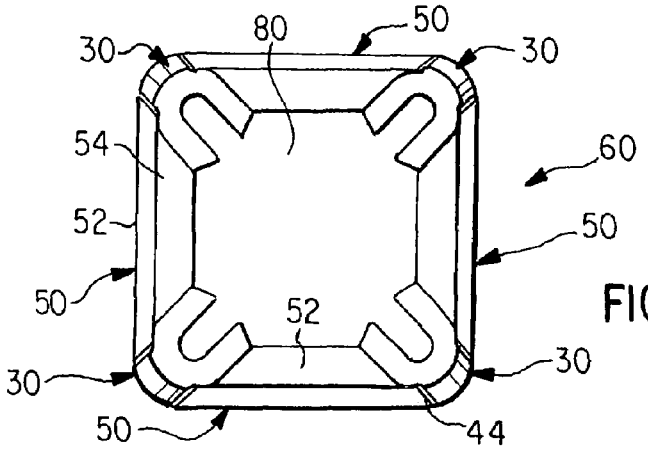
FIG. 15 is a top plan view of the transformer base shown in FIG. 14.
Figure 14:
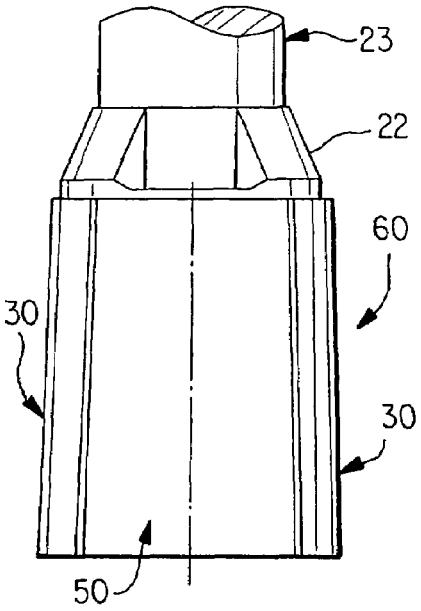
FIG. 14 is a side elevational view of a breakaway transformer base assembled from four corner members and four side plates according to the present invention, with a fragment of a lighting standard mounted thereon.
Figure 16:
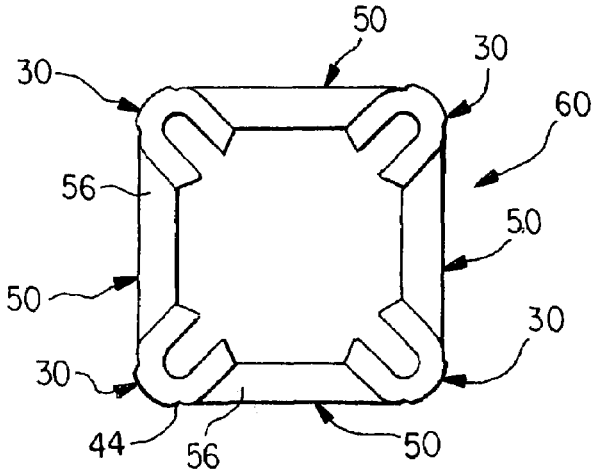
FIG. 16 is a bottom plan view of the transformer base shown in FIG. 14.

One of the single-size corner members 30 according to the invention is shown in FIGS. 4-10. A side sheet 50 is shown in FIGS. 11-13. A transformer base (preferably but not necessarily of the breakaway type) formed by the assembly of four corner members and four side sheets, is shown in FIGS. 14-16, and the base 22 of a lighting standard 23 is shown as mounted on a transformer base in FIG. 14.

The single-size corner member 30 (four per transformer base) can be formed in any suitable way such as by casting, extruding, fabrication, etc., but casting is presently preferred. The corner members can be formed of any suitable material, but aluminum is presently preferred. Each corner member includes an upstanding portion 32 terminating in upper and lower transverse faces 24*a*, 34*b* (see FIG. 10). The upstanding portion 32 is generally of U-shaped cross-section, having a pair of legs 36 joined by a bight 38 (see FIG. 9). The upstanding portion 32 forms an acute angle with the lower face 34*b*, and forms an obtuse angle with the upper face 34*a*. Thus, when the lower face 34*b* is horizontal, the upstanding portion 32 forms an acute angle a with a vertical line V.

The upper and lower faces 34*a*, 34*b* include respective bolt holes 40, 42 in the form of slots, each defined by a space between legs 36. The slots are open at one end, and the bight 38 faces away from an interior area that is enclosed by the side sheets and the corner members.

A pair of upwardly extending notches 44 is formed in a backside of each of the corner members at locations where the bight 38 merges with the legs 36. As will be explained, the side sheets 50 are attached to respective corner members 30 along those notches.

Figure 1:
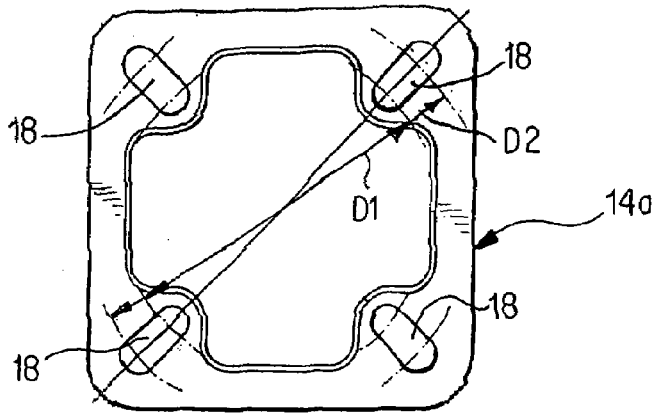
FIG. 1 PRIOR ART
FIG. 1 is a top plan view of a prior art breakaway transformer base.
Figure 2:
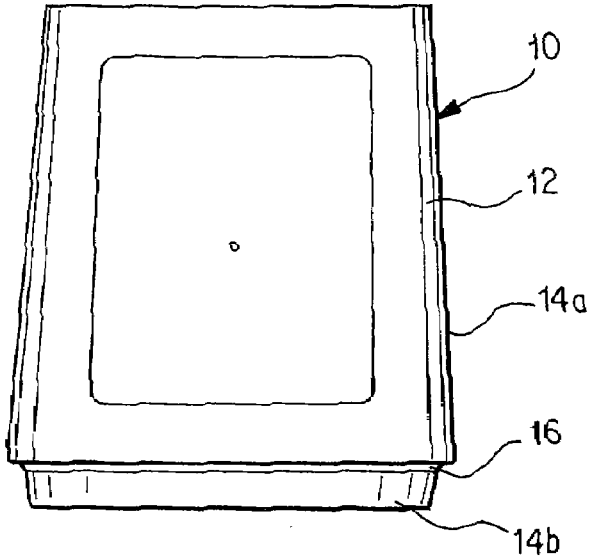
FIG. 2 PRIOR ART
FIG. 2 is a side elevational view of FIG. 1.
Figure 3:
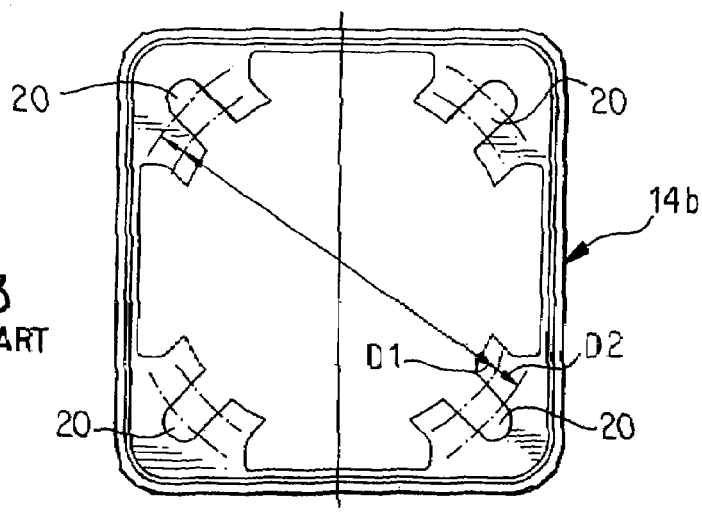
FIG. 3 PRIOR ART
FIG. 3 is a bottom plan view of FIG. 2.
Figure 7:
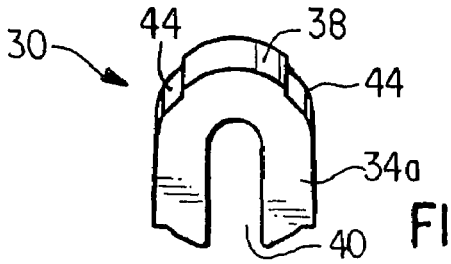
FIG. 7 is a top plan view of FIG. 4.
Figure 4:
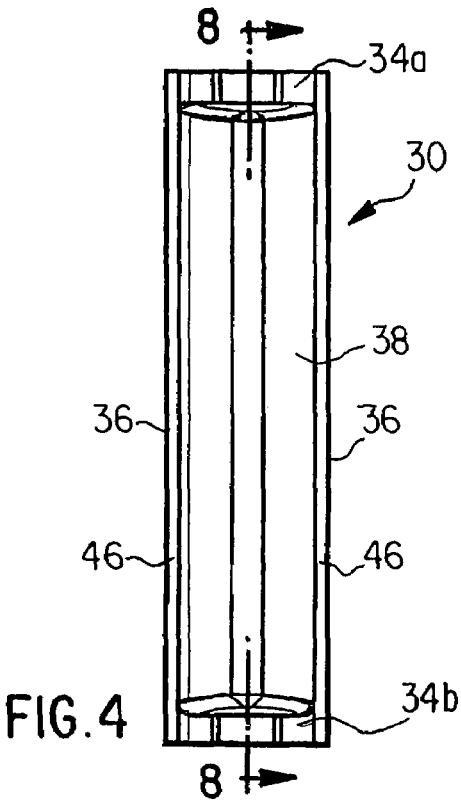
FIG. 4 is a front elevational view of a corner member according to the present invention.
Figure 5:
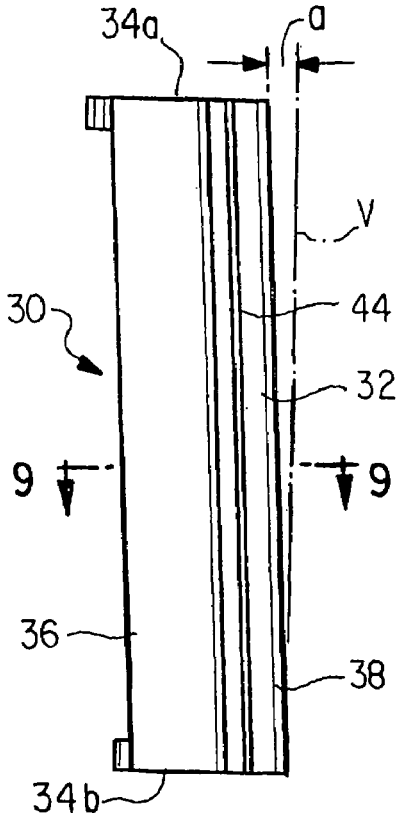
FIG. 5 is a side elevational view of FIG. 4.
Figure 6:
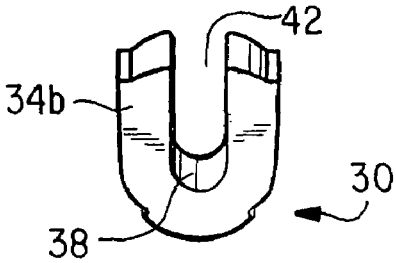
FIG. 6 is a bottom plan view of FIG. 4.
Figure 9:
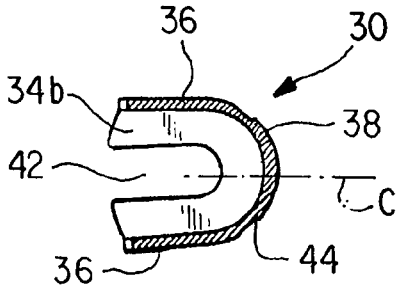
FIG. 9 is a cross-sectional view taken along the line 9-9 in FIG. 5.
Figure 8:
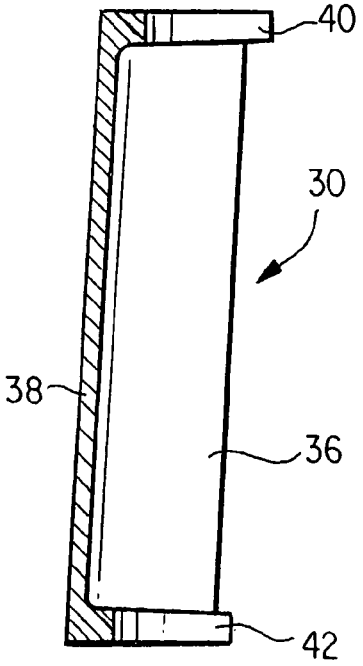
FIG. 8 is a sectional view taken along the line 8-8 in FIG. 4.
Figure 10:
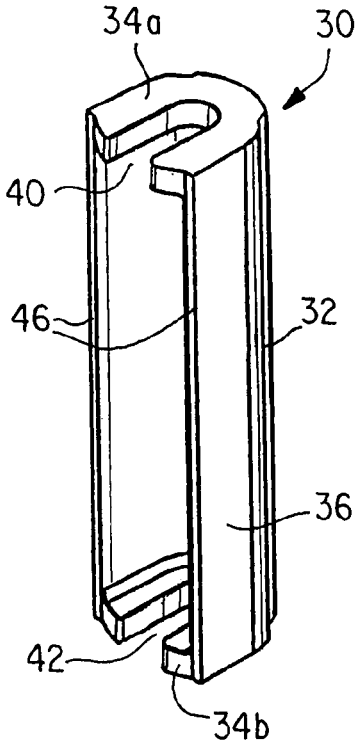
FIG. 10 is a top front perspective view of the corner member shown in FIG. 4.

The side sheets 50 for a given base size are preferably of identical size and configuration, although there could be some differences, e.g., two of the side sheets could be of square shape and the two other of non-square rectangular shape, and/or one sheet could have a door therein. The sheet 50 can be formed of any suitable material and could comprise a casting, but it is preferably stamped from aluminum to an initial pre-bent configuration shown in FIG. 11, wherein the sheet includes an upright main portion 52 and a pair of upper and lower generally horizontal flanges 54, 56. The flanges are bendable along respective bend lines 54*a*, 56*a* in the direction of arrows A shown in FIG. 12, so that a configuration shown in FIGS. 12 and 13 can be formed. The lower flange 56 forms a slightly acute included angle c with the main portion 52, whereas the upper flange 54 forms a slightly obtuse included angle with the main portion 52. When the lower flange 56 is horizontal, the main portion 52 is slightly inclined relative to vertical V by the same acute angle a as shown in FIG. 5.

The main portion 52 includes upstanding edges 58 that are slightly upwardly convergent as seen in FIG. 11.

As noted earlier, one or more of the side sheets could be provided with a removable door (not shown) for accommodating access to the base interior. To form a transformer base 60 (FIGS. 14-16) from the corner members 30 and separate side sheets 50, four side sheets 50 are welded along the notches 44 of respective identical corner members 30 by means of stitch welds. The corner members are thus interconnected solely by the side sheets (prior to the base 60 being mounted to a lighting standard 23 and to an anchored foundation (not shown)). The corner members and side sheets thus enclose an interior area 80, with the bights 38 facing away from the interior area, and the slots 42 opening into the interior area.

If the transformer base is of the breakaway type, then in the event that the lighting pole or standard 23 is struck by a vehicle which imparts an impact of at least a prescribed magnitude, the base 60 will break or shatter, thereby limiting the rate at which the vehicle is slowed, so as to minimize vehicle damage and passenger injury. In particular, the connections between the side sheets and the corner members will fail upon impact.

A base 60 can be made in different sizes, merely by employing side sheets 50 of a different size in conjunction with the single-size corner members 30. Since the same size corner members 30 are used regardless of base size, fewer corner members, which are typically heavier than the side sheets, need be kept in inventory. Of course, a sufficient number of side sheets 50 must be kept in inventory to satisfy the requirements for multiple base sizes. However, since the side sheets are relatively light in weight as compared to the corner members and occupy less space than the corner members, the inventory requirements are minimized.

The corner members are preferably exactly identical, but of course some relatively minor differences are possible (i.e., the corner members could be only substantially identical, meaning that the corner members are of basically the same size and usable to make different size bases).

Figure 17:
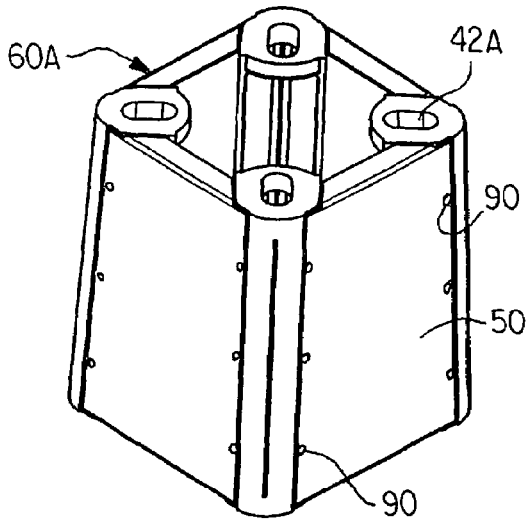
FIG. 17 is a top perspective view of a modified form of the transformer base.

Potential Modifications:

In lieu of welding all four side sheets to the respective corner members, one or more of the side sheets could be attached by fasteners such as vertically spaced removable bolts 90 as shown in the modified base 60A of FIG. 17. Other attachments are possible, e.g., the corner members could be provided with vertical slots (not shown), enabling the side sheets to be slid vertically into the slots and then retained by suitable fasteners.

By mounting the side sheet(s) using fasteners, the transformer base can be assembled in the field by the end user. It will be appreciated that shipment to the end user is simplified if the bases can be shipped in a disassembled state as a kit which includes four corner members and four side sheets.

Removability of the side sheet(s) by the use of removable fasteners also means that a high degree of access to the interior area of the base is made possible by removing one or more side sheets. Also, there would be no need to provide a removable door if the side sheet itself were removable.

In lieu of providing bolt holes 42 in the form of slots that are open at one end, the slots could be closed at both ends, e.g., see the slots 42A in the modified transformer base 60A of FIG. 17.

Although aluminum is the metal of choice for the corner members and side sheets, due in particular to aluminum's resistance to corrosion, other materials could be used. For example, if the side sheets were removably mounted to the corner members by fasteners, the corner members could be formed of cast aluminum, but the side sheets could be formed of steel.

Although the present invention has been described in connection with a preferred embodiment thereof, it will be appreciated by those skilled in the art that additions, deletions, modifications, and substitutions not specifically described may be made without departing from the spirit and scope of the invention.

What is claimed is:

1. A transformer base in combination with an exterior a lighting pole having a lighting device adjacent its upper end, the transformer base projecting upwardly from the base and comprising four substantially identical upstanding corner members, and four side sheets separate from the corner members, each side sheet being attached to two of the corner members to connect those two corner members together, each corner member including at least one bolt hole at each end thereof, wherein the corner members are mutually separate elements, and the side sheets constitute the sole means of the transformer base for interconnecting the corner members.

2. The combination according to claim 1, wherein each corner member is of generally U-shaped cross section comprised of a pair of legs joined together by a bight.

3. The combination according to claim 1, wherein the at least one bolt hole at each end of a respective corner member is disposed in a space between the legs.

4. The combination according to claim 1, wherein the corner members and the side sheets are configured such that when bottom surfaces thereof are horizontal, upstanding portions thereof converge and form an acute angle with the vertical direction.

5. The combination according to claim 2, wherein each corner member includes an upwardly extending notch disposed at a location where a leg merges with the bight, wherein each side sheet has opposing upstanding edges seated within respective notches of two corner members.

6. The transformer base according to claim 1, wherein the side sheets are welded to the corner members.

7. The combination according to claim 1, wherein the side sheets are attached to the corner members by fasteners.

8. The combination according to claim 1, wherein the corner members comprise aluminum castings.

9. The combination according to claim 1, wherein the corner members are formed of a different material than the side sheets.

10. The combination according to claim 1, wherein each side sheet includes an upright main portion and upper and lower generally horizontal flanges disposed at respective upper and lower edges of the main portion.

11. The combination according to claim 2, wherein the corner members and the side sheets enclose an interior area, with the bights facing away from the interior area.

12. The combination according to claim 10, wherein each pair of legs forms therebetween a slot in which a bolt hole is disposed.

13. The combination according to claim 1, which comprises a breakaway transformer base.

14. A transformer base for a lighting pole, comprising four substantially identical upstanding corner members, and four side sheets separate from the corner members, each side sheet being attached to two of the corner members to connect those two corner members together, each cast member including at least one bolt hole at each end thereof, wherein each corner member includes an upwardly extending notch disposed at a location where a leg merges with the bight, wherein each side sheet has opposing upstanding edges seated within respective notches of two corner members.

15. A transformer base for a lighting pole, comprising four substantially identical upstanding corner members, and four side sheets separate from the corner members, each side sheet being attached to two of the corner members to connect those two corner members together, each cast member including at least one bolt hole at each end thereof, wherein each side sheet includes an upright main portion and upper and lower generally horizontal flanges disposed at respective upper and lower edges of the main portion.

16. A transformer base for a lighting pole, comprising four substantially identical upstanding corner members, and four side sheets separate from the corner members, each side sheet being attached to two of the corner members to connect those two corner members together, each corner member including at least one bolt hole at each end thereof, wherein the corner members are mutually separate elements, and the side sheets constitute the sole means of the transformer base for interconnecting the corner members, wherein the corner members and the side sheets are configured such that when bottom surfaces thereof are horizontal, upstanding portions thereof converge and form an acute angle with the vertical direction.

* * * * *